United States Patent [19]

Boyadjieff et al.

[11] Patent Number: 4,476,936

[45] Date of Patent: Oct. 16, 1984

[54] JACKING MECHANISM SUPPORTED BY A WELLHEAD

[75] Inventors: George I. Boyadjieff, Anaheim; Andrew B. Campbell, San Marino, both of Calif.

[73] Assignee: Varco International, Inc., Orange, Calif.

[21] Appl. No.: 532,802

[22] Filed: Sep. 15, 1983

Related U.S. Application Data

[63] Continuation of Ser. No. 333,031, Dec. 21, 1981, abandoned.

[51] Int. Cl.[3] ..... E21B 19/06

[52] U.S. Cl. ..... 166/383; 166/77; 175/171; 254/29 R

[58] Field of Search ..... 175/22, 57, 171, 195, 175/202, 203; 166/71, 85, 77, 379, 380, 381, 383; 405/228, 197, 199; 254/29 R

[56] References Cited

U.S. PATENT DOCUMENTS

| | | | |
|---|---|---|---|
| 1,121,718 | 12/1914 | Derby et al. | 254/36 |
| 1,586,923 | 6/1926 | Townsend | 166/77 |
| 1,879,929 | 9/1932 | Fortune | 173/149 |
| 1,895,132 | 1/1933 | Minor | 166/77 |
| 1,904,256 | 4/1933 | Sheldon | 173/152 |
| 2,188,589 | 1/1940 | Armentrout | 166/379 |
| 2,638,324 | 5/1953 | Ball et al. | 173/149 |
| 3,257,099 | 6/1966 | Merritt, Jr. | 254/105 |
| 3,282,357 | 11/1966 | Bunn | 175/122 |
| 3,722,603 | 3/1973 | Brown | 173/159 |
| 3,797,570 | 3/1974 | Leutwyler | 166/77 |
| 3,888,318 | 6/1975 | Brown | 173/149 |
| 3,949,883 | 4/1976 | Crooke et al. | 214/1 P |

FOREIGN PATENT DOCUMENTS

| | | | |
|---|---|---|---|
| 691340 | 7/1964 | Canada | 166/77 |
| 1063096 | 1/1960 | Fed. Rep. of Germany . | |
| 2552095 | 5/1976 | Fed. Rep. of Germany . | |
| 2071734 | 9/1981 | United Kingdom . | |

OTHER PUBLICATIONS

"New Easing Tools may Eliminate Need for Super Rigo", by Abbott et al., Oil & Gas Journal—Jul. 21, 1980.

World Oil, Oct. 1980, pp. 80 and 81.

Article entitle "Look, They're Snubbing When They Aren't Even in Trouble", Drilling—DCW, Apr. 20, 1977.

*Primary Examiner*—Stephen J. Novosad
*Assistant Examiner*—Hoang C. Dang
*Attorney, Agent, or Firm*—William P. Green

[57] ABSTRACT

Jacking mechanism for moving a string of casing or other well pipe vertically within a well and including two units operable to releasably engage and support the pipe, power actuated mechanism for moving one of the units upwardly and downwardly relative to the other to jack the pipe vertically through a wellhead structure, and apparatus for supporting the power actuated mechanism and units at least in part from that wellhead structure.

6 Claims, 9 Drawing Figures

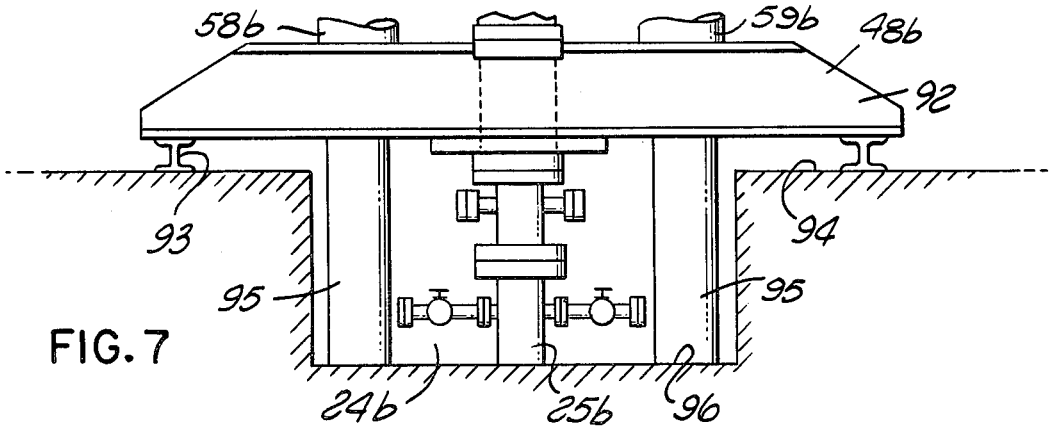
FIG. 7
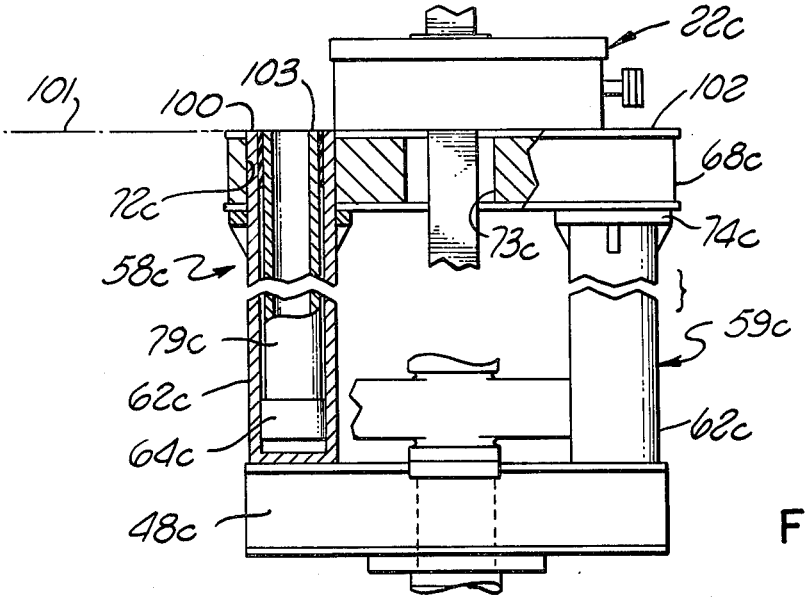
FIG. 8
FIG. 9
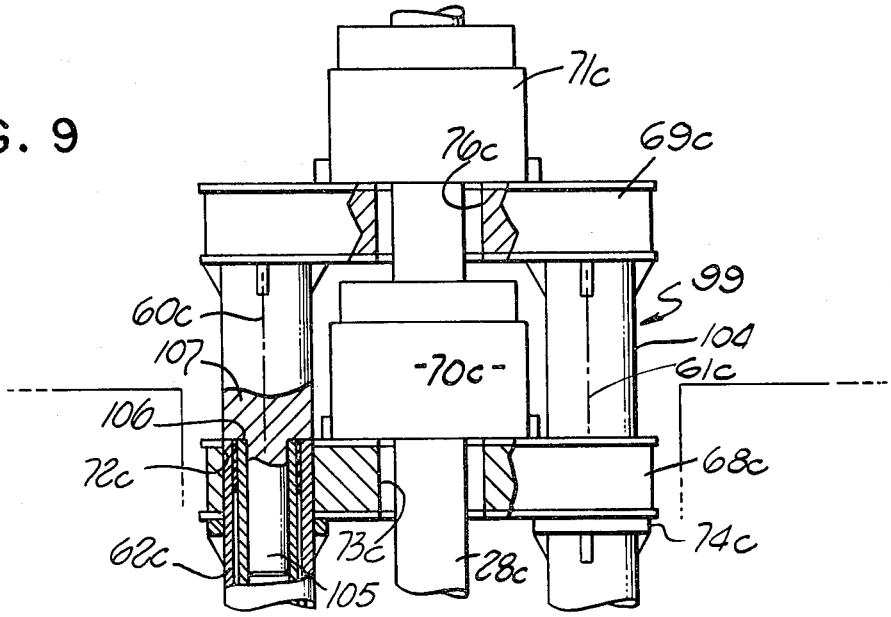

JACKING MECHANISM SUPPORTED BY A WELLHEAD

This application is a continuation of Ser. No. 6/333,031, filed Dec. 12, 1981, now abandoned.

BACKGROUND OF THE INVENTION

This invention relates to jacking mechanism for moving a string of well pipe vertically within a well.

Jacking mechanisms embodying the invention are of a general type disclosed in several prior copending applications and especially adapted in certain respects for lowering a heavy string of casing through a wellhead and into a well after completion of the process of drilling the well. This jacking mechanism may include two units which are adapted to engage and support a pipe at different locations and power actuated means for moving one of those units upwardly and downwardly relative to the other to attain the desired jacking action. The power actuated means preferably take the form of two piston and cylinder mechanisms located at opposite sides of the well axis and positioned in the rig near the rotary table location.

SUMMARY OF THE INVENTION

The present invention provides an improved arrangement for supporting the load of the jacking mechanism and the well pipe suspended thereby in areas in which the soil at the surface of the earth may be alluvial in character and offer insufficiently reliable support to render practical direct transmission of load forces from a jacking mechanism to the ground through a footing or base structure resting on the surface of the earth. To attain effective support under such circumstances, the present invention contemplates transmission of some or all of the load forces from the jacking mechanism to the wellhead structure at the upper end of the well. The wellhead is in turn connected to and carried by the upper end of a surface casing or other casing string which extends downwardly into and lines an upper portion of the well and which is held in place by engagement with the well bore wall along an extended distance and/or by cementing the casing to the earth formation. The invention may also be of use in situations in which the surface of the earth might have sufficient load supporting capacity to permit direct transmission of the jacking load thereto, but in which a simpler and less expensive or otherwise more effective or desirable load support pattern can be attained by applying some or all of the jacking load to the wellhead and the surface casing connected thereto.

The transmission of load forces to the wellhead may be effected by connecting to the wellhead a support beam which has a tubular portion aligned with the interior of the wellhead and which projects laterally from that tubular portion to a side or sides of the well axis. Preferably, the beam has two projections extending in opposite directions from its central tubular portion and supporting two piston and cylinder mechanisms by which the relatively movable pipe contacting units are carried and actuated. In one form of the invention, the wellhead acts during a drilling operation to support the rotary table of the drilling rig through the jacking cylinders.

BRIEF DESCRIPTION OF THE DRAWINGS

The above and other features and objects of the invention will be better understood from the following detailed description of the typical embodiments illustrated in the accompanying drawings, in which:

FIG. 7 represents fragmentarily an additional variation;

FIG. 8 is a fragmentary vertical section through another variational form of the invention, shown as it appears during the drilling operation with the rotary table in place; and FIG. 9 shows the apparatus of FIG. 8 after the drilling has been completed and during lowering of a string of casing into the well.

DESCRIPTION OF THE PREFERRED EMBODIMENTS

Figure 1:
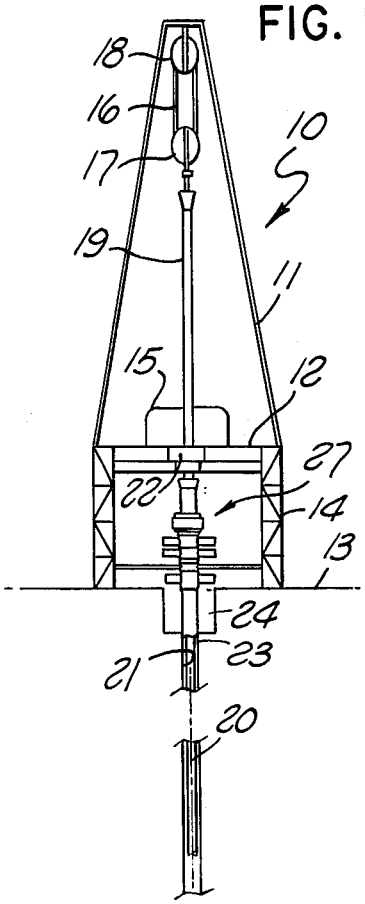
FIG. 1 represents somewhat diagrammatically a well drilling rig which is adapted for use with a first form of casing jacking mechanism, but which is illustrated in FIG. 1 as the rig appears during the drilling operation and before the major portion of the jacking mechanism has been moved into place.

The drilling rig 10 of FIG. 1 has a framework structure including an upwardly projecting derrick or mast 11, a rig floor 12 spaced above the earth 13 and a substructure 14 supporting the derrick, floor and other related equipment from the ground. A conventional drawworks represented at 15 including an engine or other power source acts to reel in or release a line 16 to move the usual traveling block 17 upwardly and downwardly relative to crown block 18 secured to the upper end of the derrick. During the drilling operation represented in FIG. 1, traveling block 17 suspends the drill string 19, and gradually lowers it along vertical axis 20 to drill well 21 as the string and a bit carried at its lower end are rotated by rotary table 22 driven by the drawworks. In FIG. 1, it is assumed that an initial portion of the well has already been drilled, and that a first string of surface casing or other casing 23 has been positioned in the upper portion of the well, and is effectively retained in position in the well and supported by engagement with the well bore wall along a substantial axial length and by cementing to the formation. Drill string 19 is then advanced downwardly through that upper string of casing 23 to drill the lower portions of the well. The upper end of casing 23 projects upwardly into a cellar 24 at the surface of the earth, and has an exposed portion 25 serving as the wellhead and having a connector flange 26 by which the wellhead is attachable to a blowout preventer assembly 27 containing and defining a vertical passage through which drill pipe 19 and ultimately a string of casing 28 (FIG. 3) can be lowered along axis 20 through wellhead 25 and surface casing 23 into the lower portion of the well.

The blowout preventer assembly 27 may include a first mounting pipe section 29 having a lower flange connected by bolts 30 to flange 26 of the wellhead, and having an upper flange connected by bolts 31 to a lower one of three ram-type blowout preventers 32, 33 and 34. Above these ram-type blowout preventers, there may be provided an annular seal-type blowout preventer 35, having an upwardly projecting tube 36 with a flaring funnel-like upper portion 37 into which the drill string 19 or casing 28 is insertable downwardly. Preventer 35 contains sealing elements adapted to be constricted inwardly into annular engagement with the drill string or casing 28 to form an annular seal therewith. Blowout preventers 32 and 34 contain rams represented at 38 which are actuable horizontally inwardly against a drill string or casing to form an annular seal therewith, while preventer 33 may be of a type in which the rams 39 are adapted to close an open hole in the absence of a drill pipe or casing in the central passage, and to cut through a drill pipe or other pipe if necessary and then form a closure when conditions require that action. Other blowout preventer arrangements may of course be utilized in lieu of the typical assembly illustrated in FIGS. 1 and 3. The blowout preventers are normally connected to the wellhead as shown at an early stage during a drilling operation, and remain in position as the rest of the well is drilled and during the lowering of most of the casing into the well.

The rotary table 22 may be of conventional construction, and during drilling may be positioned on a pair of parallel horizontally extending support beams 40 (FIG. 2), received at the opposited sides of the main vertical axis 20 of the well and rig and supported from the usual spreader beams 41 which are secured to and supported by the substructure 14 of the rig. The rotary table is typically illustrated in FIG. 2 as including a nonrotating main body 42 by which a central rotary section 43 is supported through bearings 44 for rotation about vertical axis 20. A master bushing and kelly bushing assembly 45 is positioned in the rotary table during drilling, and acts to transmit rotary motion from section 43 to the drill string, while permitting the string to advance downwardly as the well is drilled. The rotary section 43 of the rotary table is driven by the drawworks through a chain and sprocket drive represented at 46. After the drilling operation has been completed, rotary table 22 can be removed from the rig in order to allow the jacking mechanism to be moved into place as represented in FIG. 3.

Figure 3:
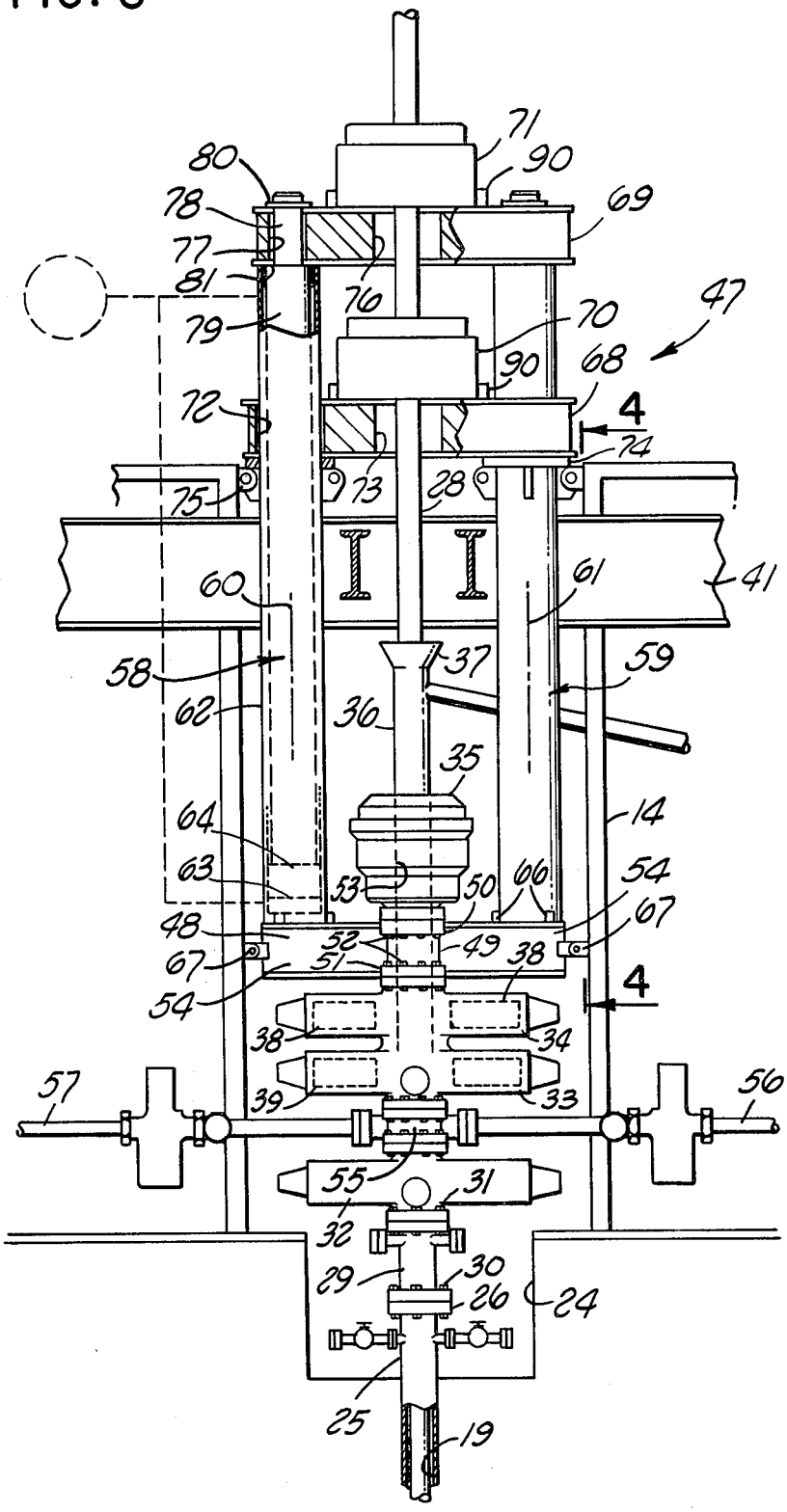
FIG. 3 is an enlarged primarily elevational view, partially in section, representing the rig of FIG. 1 after the jacking mechanism has been positioned in the rig.

The jacking mechanism is identified generally by the reference number 47 in FIG. 3. In order to support this jacking mechanism and the well pipe engaged thereby from wellhead 25 in accordance with the teachings of the present invention, there is connected to the wellhead a jack support beam 48, which in the FIG. 3 arrangement is interposed vertically between the two blowout preventers 34 and 35. Beam 48 preferably has a central tubular portion 49 taking the form of a short length of high strength pressure resistant pipe having upper and lower annular flanges 50 and 51 connectable in sealed relation to flanges of the two blowout preventers 35 and 34 respectively by two annular series of bolts 52. This central tubular portion of beam 48 thus forms part of the continuous vertical passage 53 extending through and formed within and by the blowout preventers and beam 48, and continuing from the upper flaring end 37 of tube 36 to wellhead 25. This passage is aligned with the passage within the wellhead and allows the discussed vertical extension and movement of a drill pipe or casing through this entire assembly and into the well.

In addition to the central tubular portion 49, beam 48 may include a number of rigid metal parts appropriately welded or otherwise secured to central tube 49 and to one another in a manner forming a rigid integrated structure having two projections 54 extending in diametrically opposite directions from center tube 49 and of a strength to take the vertical load forces of the jacking mechanism and transmit those forces effectively to the blowout preventers and through those blowout preventers and connected parts to the wellhead. Vertically between blowout preventers 32 and 33, there may be provided a short rigid tubular sub or fitting 55 attached to the blowout preventers in sealed and load transmitting relation, and from which the usual choke line 56 and kill line 57 extend laterally in opposite directions.

In addition to support beam 48, the jacking mechanism 47 includes two fluid actuated piston and cylinder assemblies 58 and 59, supported by opposite ends of beam 48 and projecting upwardly therefrom along two axes 60 and 61 disposed parallel to one another and to main vertical axis 20 of the well and rig. Each of the assemblies 58 and 59 includes a cylinder 62 closed at its lower end by a bottom wall 63 and containing a piston 64 which is actuable upwardly and downwardly relative to the cylinder along axis 60 or 61 by pressurized hydraulic fluid supplied to the upper or lower end of the cylinder from a controlled pressure fluid source 65. The lower ends of the cylinders may be located relative to beam 48 by reception between locating lugs 66 carried on the upper surface of beam 48 and projecting upwardly therefrom at different sides of the cylinders. Bracing connections between beam 48 and the substructure of the rig framework structure may be provided at 67, consisting of lugs carried by beam 48 and substructure 14 and containing registering openings through which connector pins can extend.

Two rigid load supporting beams 68 and 69 are connected to the piston and cylinder mechanisms near their upper ends, and extend horizontally therebetween, and act to support two gripping units 70 and 71 for engaging and gripping the drill pipe or suspended casing. These beams may be formed sectionally of a number of parts welded or otherwise secured together, but are typically illustrated as integral one-piece structures. Beam 68 contains two cylindrical openings 72 centered about axes 60 and 61 and within which the cylinders 62 are close fits, in a manner locating the upper ends of the cylinders with beam 68 extending horizontally therebetween. A central opening 73 in the beam allows extension of a well pipe downwardly through the beam. Support rings 74 are rigidly welded or otherwise secured to the outer surfaces of the cylinders beneath beam 68, and act to support the weight of the beams and loads applied thereto through the walls of cylinders 62 and then through beams 48, in a manner transmitting those load forces to wellhead 25. In the arrangement of FIG. 3, the bracing connections 67 are assumed to be light enough that they do not take any substantial portion of the downward load forces from the jacking mechanism, but rather permit transmission of substantially all of the load to the wellhead. Similar bracing connections may be provided at 75 between cylinders 62 and the substructure of the rig. These connections are also assumed to be of a type serving only to locate the cylinders laterally and not to take any substantial portion of the downward load forces from the jacking mechanism. To assure against transmission of downward forces through connections 67 and 75, the pins of these connections may have sufficient looseness to permit some downward movement of the cylinders relative to the rig substructure without applying any downward forces to that substructure.

Beam 69 contains a central opening 76 through which the suspended pipe string extends, and contains two diametrically opposite vertically extending cylindrical passages 77 through which upper reduced end portions 78 of the piston rods 79 extend, with those upper ends 78 being retained in openings 77 by snap rings 80 or the like. Annular shoulders 81 formed on the piston rods near their upper ends are engageable with the undersurface of beam 69 in a manner supporting the beam and its load forces from the piston, and actuating the beam upwardly and downwardly in correspondence with upward and downward movement of the pistons.

Figure 5:
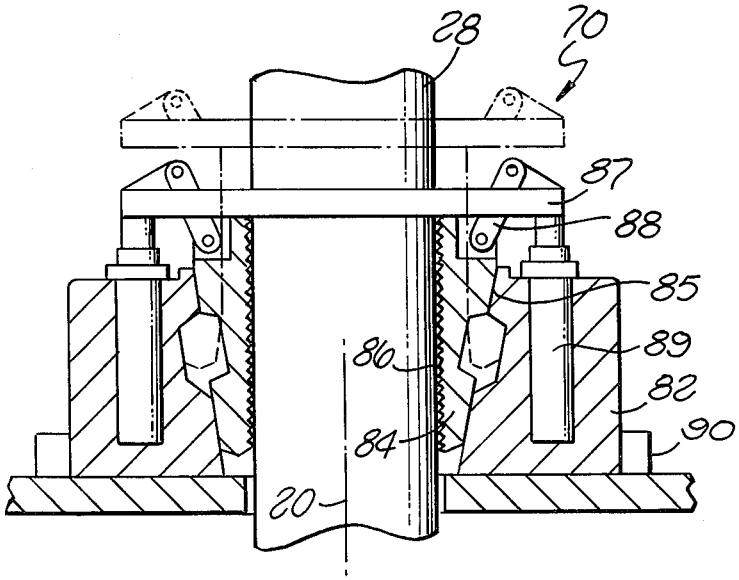
FIG. 5 is an enlarged fragmentary vertical section taken on line 5—5 of FIG. 3.
Figure 4:
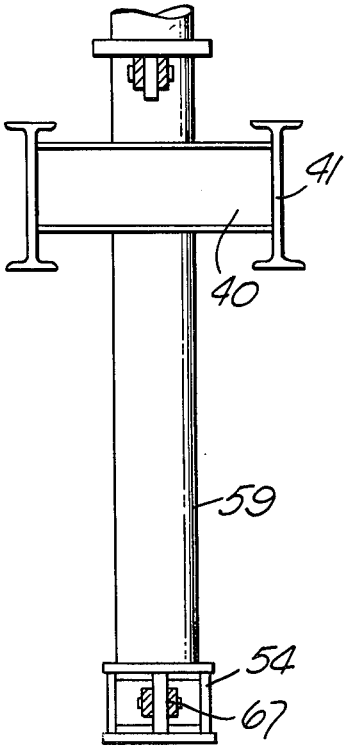
FIG. 4 is a fragmentary vertical section taken on line 4—4 of FIG. 3.

The two units 70 and 71 rest on the upper surfaces of beams 68 and 69, engaging those surfaces about openings 73 and 76, and contain passages through which the suspended string extends. Units 70 and 71 are adapted to releasably engage and support the casing 28 suspended by the jacking mechanism, and preferably are slip type gripping units which may be identical and one of which is represented somewhat diagrammatically in FIG. 5. The gripping unit as there shown includes a rigid essentially annular body 82 centered about axis 20 and engageable by circularly spaced wedge slips 84 having outer tapering surfaces engaging correspondingly tapered surfaces of the slip bowl at 85 to cam the slips inwardly in response to downward movement thereof. The inner gripping faces 86 of the slips are formed with teeth or other irregularities adapted to engage the outer surface of the casing pipe 28 and support it in the well. An actuating ring 87 suspends the slips by links 88 pivoted at opposite ends to the ring and slips respectively. A series of circularly spaced piston and cylinder mechanisms 89 are actuable controllably to move ring 87 and the slips upwardly and downwardly between the lower active gripping positions represented in full lines in FIG. 5 and upper retracted positions shown in broken lines in that figure. In those upper positions, the slips move outwardly away from casing 28, as permitted by links 88 to free the casing for upward and downward movement relative to the gripping unit.

To recapitulate briefly the manner in which a well is drilled and then cased by the apparatus illustrated in FIGS. 1 through 5, during the initial stages of the drilling operation the surface casing 23 and connected wellhead and blowout preventer assembly 27 may not be present beneath the rig floor, but the rotary table 22 is in position as shown in FIG. 1, and drill string 19 is turned by the rotary table and progressively advanced downwardly as the bit carried at the lower end of the string drills the initial portion of the hole. At an early stage during the drilling operation and after a short length of the hole has been drilled, casing 23 is moved into position in conventional manner, with its upper wellhead portion 25 projecting above the ground, and the various blowout preventers are connected rigidly to the wellhead with jack support beam 48 secured rigidly thereto. Piston and cylinder mechanisms 58 and 59 of the jacking mechanism, and the upper portions of the jacking mechanism, are not at this time located in the rig. The drilling operation is then continued beyond the lower end of casing 23 and to the depth desired for the well, with the rotary table acting through the upper kelly portion of the drill string 19 to continue the drilling.

Figure 2:
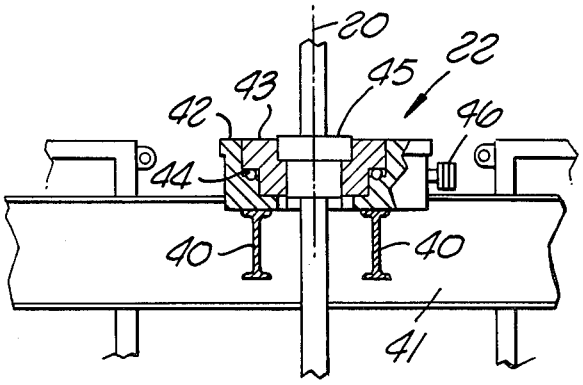
FIG. 2 is an enlarged vertical section through the rig of FIG. 1, taken at the location of the rotary table.

When the well has reached the desired depth, drill string 19 may be removed upwardly from the well, and rotary table 22 may be removed from its FIGS. 1 and 2 active position in the rig, after which the jacking mechanism may be moved into position as shown in FIG. 3. To assemble the jack in place, piston and cylinder assemblies 58 and 59 may first be lowered downwardly along axes 60 and 61 and to positions of support on the opposite ends of beam 48, with the lower ends of the cylinders being located by reception within the socket recesses formed by and between lugs 66 on beam 48. The upper ends of the cylinders may be located laterally by connections 75, and beam 68 is then connected to the cylinders by positioning beam 68 above the upper ends of the cylinders and lowering beam 68 along the cylinders with the latter being received within and located by passages 72 in the beam. This lowering operation is continued until beam 68 is effectively supported by the cylinders through rings 74. The upper beam 69 is then positioned above the upper ends of the piston rods, and lowered to move the piston rods into passages 77 in beam 69 as represented at FIG. 3, with the final connection being formed by snap rings or other connectors 80. Gripping units 70 and 71 are positioned on the upper surfaces of beams 68 and 69, being located by reception between lugs 90 secured to and projecting upwardly from the upper surfaces of the beams at different sides of units 70 and 71.

With the jacking apparatus in the condition of FIG. 3, the string of casing 28 is lowered by the jack through passage 53 in the blowout preventer assembly and related parts and through the inner passage in wellhead 25, and is then advanced downwardly through casing 23 into the lower portion of the well beneath casing 23. The main string of casing 28 may be of a weight greater than the maximum capacity which the rig framework structure, drawworks 15, line 16 and block 17 and 18 could support in conventional manner, but within the capacity of the special jacking mechanism supplied by the present invention. The casing is lowered by steps, being first gripped and supported by unit 70 while beam 69 and gripping unit 71 are actuated upwardly by the piston and cylinder mechanism, after which unit 71 is actuated in a manner causing its slips to grip and support the casing 28 while unit 70 is released, so that the pistons may then be moved downwardly to lower beam 69 and gripping unit 71 and the suspended casing 28 through a distance corresponding to the range of movement of the pistons. Unit 70 is then actuated to again grip the casing and support it while beam 69 and unit 71 are actuated upwardly for the next successive lowering step. This operation is repeated until the casing 28 has been lowered to the desired depth in the well. During the casing lowering operation, all load forces are taken by the wellhead 25 itself, and transmitted from that wellhead through casing 23 to the well bore wall over an extended vertical distance, thus avoiding transmission of the load forces to the earth's surface which may be of a character incapable of taking those forces.

Figure 6:
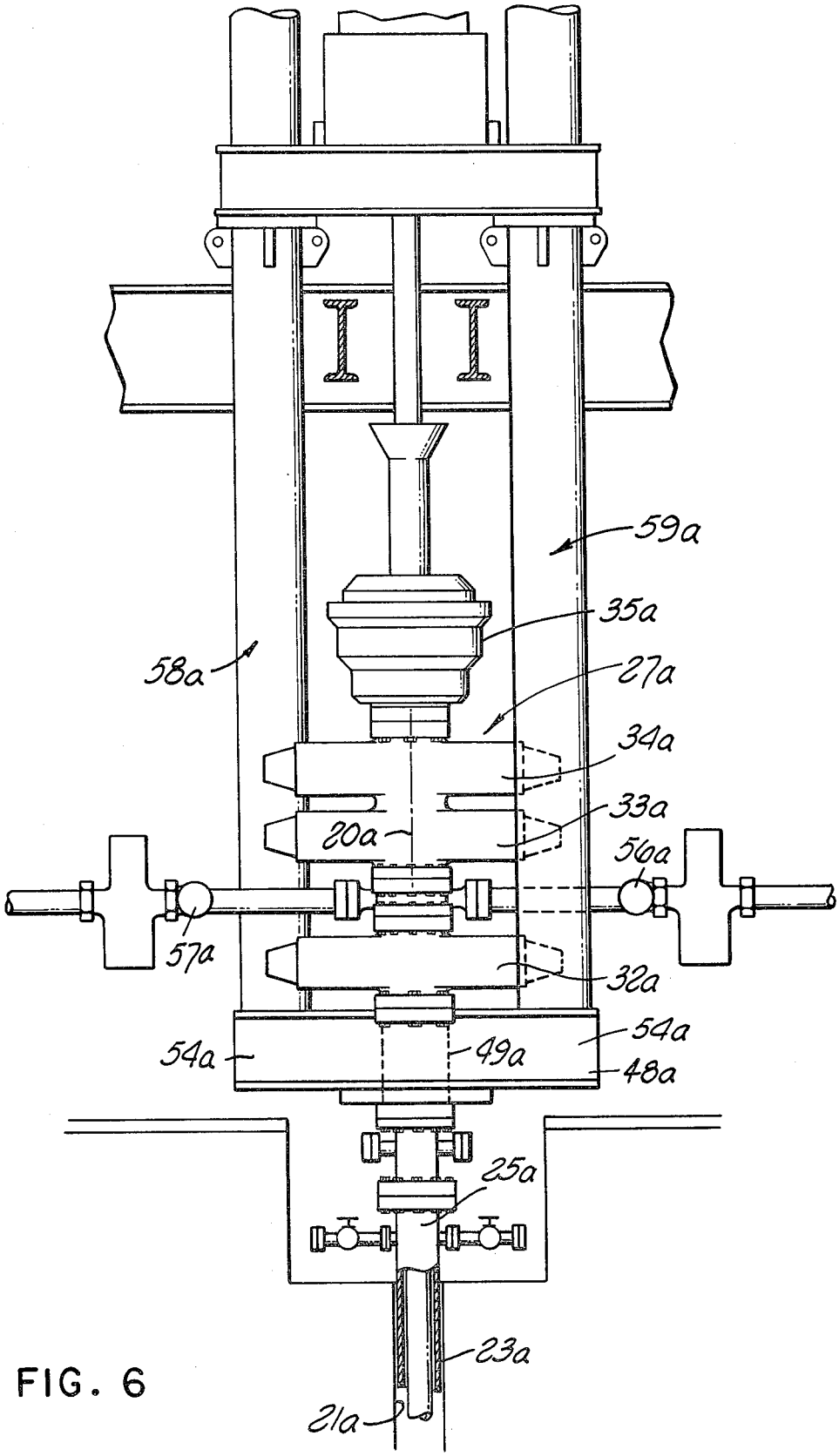
FIG. 6 is a fragmentary view similar to FIG. 3 but showing a variational form of jacking mechanism embodying the invention.

FIG. 6 illustrates fragmentarily an arrangement which may be considered as identical to that shown in FIGS. 1 through 5 except that the load supporting beam **48*a* corresponding to beam 48 of FIG. 3 is connected to the wellhead mounted assembly 27*a* at a location beneath all of the blowout preventers 32*a*, 33*a*, 34*a*** and 35*a* rather than at the location shown in FIG. 3. Beam 48*a* may be constructed the same as beam 48 of FIG. 3, including a central vertical tubular or pipe portion 49*a* and projections 54*a* extending in diametrically opposite directions therefrom. The cylinders of piston and cylinder mechanisms 58*a* and 59*a* are the same as assemblies 58 and 59 of FIG. 3, except that both of the pistons and cylinders are longer in FIG. 6 to extend downwardly for engagement with and support by the lower beam 48*a*. If the ram type blowout preventers 32*a*, 33*a* and 34*a* are long enough horizontally to otherwise interfere with piston and cylinder mechanisms 58*a* and 59*a*, the blowout preventers may be turned about axis 20*a* relative to the piston and cylinder mechanisms in accordance with the teachings of another U.S. patent application copending herewith to avoid interference between the parts. Similarly, the choke line 56*a* and kill line 57*a* may be located to avoid interference with the piston and cylinder mechanisms. Wellhead 25*a* may be the same as wellhead 25 of FIG. 3, and be connected to a surface casing or other casing 23*a* lining the upper portion of the well 21*a*. Beam 48*a* is rigidly connected to and supported by wellhead 25*a* and casing string 23*a*, to transmit all load forces of the jacking mechanism through beam 48*a* to the wellhead and casing 23*a* and therethrough to the well bore wall, without direct downward application of those forces to the surface of the earth. As in the first form of the invention, the rotary table is first utilized to drill the well, before the piston and cylinder mechanisms and upper portions of the jacking mechanism are moved into place, after which the rotary table is removed and the jack located in the rig to lower the main casing string into the lower portion of the well.

FIG. 7 represents another variational arrangement which may be considered as identical with that of FIG. 6, except that beam 48*b* which is connected to and supported by wellhead 25*b* has end portions 92 which project laterally beyond piston and cylinder mechanisms 58*b* and 59*b* and which are engageable with rails 93 resting on a base 94 formed of cement or the like to assist in supporting the jacking load. Also, additional support elements 95 may project downwardly beneath beam 48*b* at locations under the piston and cylinder mechanisms 58*b* and 59*b* to support a portion of the jacking load through these elements 95 from the cement base 96 of cellar 24*b*. Thus, in the FIG. 7 arrangement, a large portion of the jacking load is taken by wellhead 25*b* and the connected surface casing, but this support is supplemented by transmission of some of the jacking load through elements 93 and 95 to the surface of the earth.

FIGS. 8 and 9 illustrate another form of the invention in which the piston and cylinder mechanisms remain in place in the rig during the drilling operation, and preferably act to themselves support the rotary table 22*c* as it drills the well, with the wellhead mounted beam 48*c* (corresponding to beams 48, 48*a* and 48*b* of the first forms of the invention) thus acting to transmit the rotary table loads to the wellhead. The two piston and cylinder mechanisms 58*c* and 59*c* of FIGS. 8 and 9 include cylinders 62*c* which are supported at their lower ends by beam 48*c* in the manner discussed in connection with the first form of the invention, but whose upper ends are cut off to allow detachable connection thereto of an upper piston extension member 99 which is not present in the rig during drilling but is present during a jacking operation. Beam 68*c* of FIGS. 8 and 9 may be essentially the same as beam 68 of FIG. 3, and contain a central opening 73*c* and two openings 72*c* near its opposite ends closely receiving the upper ends of cylinders 62*c* in locating relation, with the beam being supported from the cylinders by rings 74*c* welded thereto. The upper end surfaces 100 of the cylinders are flush with and lie in the same horizontal plane 101 as the upper horizontal surface 102 of beam 68*c*. The piston rods 79*c* of pistons 64*c* are tubular, and have their upper end surfaces 103 positioned to lie in plane 101 in the FIG. 8 lowermost positions of the pistons. Thus, in the lower positions of the pistons, the upper surface of beam 68*c* is unobstructed and allows mounting of rotary table 22*c* on that upper surface for drilling of a well.

Extension member 99 includes an upper beam 69*c* similar to beam 69 of FIG. 3 and having a central opening 76*c* through which a casing being lowered can extend. Two rod extension elements 104 are rigidly welded or otherwise secured to beam 69*c* and project downwardly therefrom in parallel relation and along axes 60*c* and 61*c* of the piston and cylinder mechanisms, and have lower reduced diameter end portions 105 projecting downwardly into and located by the upper ends of tubular piston rods 79*c*. Annular shoulders 106 formed on piston rod extensions 104 at the juncture of their upper large diameter portions 107 and lower reduced diameter portions 105 are engageable with the upper end surfaces 103 of rods 79*c* to support extension member 99 on the piston rods and move it upwardly and downwardly therewith in correspondence with movement of the pistons. Gripping units 70*c* and 71*c* may be the same as units 70 and 71 of the first form of the invention, and be removably supported on beams 68*c* and 69*c*.

During drilling with the FIGS. 8 and 9 apparatus, the pistons are as discussed moved to their FIG. 8 lowermost positions, and the rotary table is placed on beam 68*c* and connected to the engine of the drawworks to power rotate the drill string. After the well has been drilled to a desired depth, the rotary table 22*c* is removed from beam 68*c*, and extension 99 is lowered relative to the piston and cylinder mechanisms to move elements 105 into the upper ends of the piston rods and support extension 99 on those rods, with gripping units 70*c* and 71*c* then being positioned on the two beams 68*c* and 69*c* for support thereby. The piston and cylinder mechanisms may then be actuated to move beam 69*c* and gripping unit 71*c* upwardly and downwardly, with alternate actuation of the gripping units to release and grip casing 28*c* as previously discussed, in a manner progressively lowering that casing into the well.

While certain specific embodiments of the present invention have been disclosed as typical, the invention is of course not limited to these particular forms, but rather is applicable broadly to all such variations as fall within the scope of the appended claims.

We claim:

1. The method that comprises:

drilling a well utilizing a rig having a mast projecting upwardly above the well in a predetermined drilling position, and having a rig floor and a rotary table, and utilizing a drill string suspended by said mast and turned by said rotary table and extending downwardly along a predetermined axis relative to said mast and through said rig floor and into the well;

removing said drill string from the rig after completion of the drilling operation;

positioning in the well after at least a portion of the drilling operation has been completed a first length of casing of a relatively large diameter having a tubular wellhead structure connected thereto and spaced beneath the rig floor;

lowering through said wellhead structure and through said first length of casing while said mast remains in said drilling position above the well, a string of smaller diameter casing which, during at least a portion of the lowering operation, has a weight greater than the load supporting capacity of said mast used in drilling;

effecting the downward movement of said string of smaller diameter casing, during at least said portion of the lowering operation when the weight of said casing string exceeds the capacity of the mast, by actuating a first casing supporting unit of a jacking mechanism which is accessible from above the rig floor upwardly and downwardly relative to a second casing supporting unit of the jacking mechanism which is accessible from above the rig floor by means of a plurality of fluid pressure operated piston and cylinder mechanisms projecting downwardly beneath the level of the rig floor, with the casing string being supported alternately by the two units respectively; and transmitting load forces resulting from the weight of said casing string from each of said supporting units downwardly beneath the level of said rig floor and to said tubular wellhead structure at a location spaced beneath the rig floor and then at least in part through said wellhead structure to the earth, without transmission of said forces through said mast, but while said mast used in driling remains in said drilling position above the well;

said method including supporting said rotary table from said wellhead structure through said piston and cylinder mechanisms during drilling of the well.

2. The method as recited in claim 1, including removing said rotary table from the rig after completion of the drilling operation, and connecting an extension structure carrying said first casing supporting unit to the upper ends of said piston and cylinder mechanisms after removal of the rotary table.

3. The method as recited in claim 1, in which said load forces are transmitted downwardly beneath said rig floor through said piston and cylinder mechanisms to said wellhead structure.

4. The method as recited in claim 1, in which load forces are transmitted downwardly from said first casing supporting unit through tubular vertically extending side walls of the cylinders of said piston and cylinder mechanisms from an upper location at which said first unit is supported by said side walls to said wellhead structure.

5. The method as recited in claim 1, including installing at least a portion of said jacking mechanism in the rig after completion of said drilling operation.

6. The method that comprises:

drilling a well utilizing a rig having a mast projecting upwardly above the well in a predetermined drilling position, and having a rig floor and a rotary table, and utilizing a drill string suspended by said mast and turned by said rotary table and extending downwardly along a predetermined axis relative to said mast and through said rig floor and into the well;

removing said drill string from the rig after completion of the drilling operation;

positioning in the well after at least a portion of the drilling operation has been completed a first length of casing of a relatively large diameter having a tubular wellhead structure connected thereto and spaced beneath the rig floor;

lowering through said wellhead structure and through said first length of casing while said mast remains in said drilling position above the well, a string of smaller diameter casing which, during at least a portion of the lowering operation, has a weight greater than the load supporting capacity of said mast used in drilling;

effecting the downward movement of said string of smaller diameter casing, during at least said portion of the lowering operation when the weight of said casing string exceeds the capacity of the mast, by actuating a first casing supporting unit of a jacking mechanism which is accessible from above the rig floor upwardly and downwardly relative to a second casing supporting unit of the jacking mechanism which is accessible from above the rig floor by means of a plurality of fluid pressure operated piston and cylinder mechanisms projecting downwardly beneath the level of the rig floor, with the casing string being supported alternately by the two units respectively; and transmitting load forces resulting from the weight of said casing string from each of said supporting units downwardly beneath the level of said rig floor and to said tubular wellhead structure at a location spaced beneath the rig floor and then at least in part through said wellhead structure to the earth, without transmission of said forces through said mast, but while said mast used in drilling remains in said drilling position above the well;

said method including removing said rotary table from the rig after completion of the drilling operation, and connecting an extension structure carrying said first casing supporting unit to the upper ends of said piston and cylinder mechanisms after removal of the rotary table.

* * * * *